US009701592B1

(12) United States Patent
Patel et al.

(10) Patent No.: US 9,701,592 B1
(45) Date of Patent: Jul. 11, 2017

(54) SINGLE-STEP PRODUCTION METHOD FOR NANO-SIZED ENERGETIC COCRYSTALS BY BEAD MILLING AND PRODUCTS THEREOF

(71) Applicants: Rajen B. Patel, Parsippany, NJ (US); Hongwei Qiu, Harrison, NJ (US); Victor Stepanov, Highland Park, NJ (US); Reddy Damavarapu, Hackettstown, NJ (US)

(72) Inventors: Rajen B. Patel, Parsippany, NJ (US); Hongwei Qiu, Harrison, NJ (US); Victor Stepanov, Highland Park, NJ (US); Reddy Damavarapu, Hackettstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 141 days.

(21) Appl. No.: 14/819,730

(22) Filed: Aug. 6, 2015

(51) Int. Cl.

| | |
|---|---|
| ***C06B 45/00*** | (2006.01) |
| ***D03D 23/00*** | (2006.01) |
| ***D03D 43/00*** | (2006.01) |
| ***C06B 25/34*** | (2006.01) |
| ***C06B 21/00*** | (2006.01) |

(52) U.S. Cl.
CPC ..... *C06B 25/34* (2013.01); *C06B 21/0066* (2013.01)

(58) Field of Classification Search
USPC ..... 149/2, 108.8, 109.4, 109.6
See application file for complete search history.

(56) References Cited

U.S. PATENT DOCUMENTS

2012/0305150 A1* 12/2012 Matzger ..... C06B 21/0066 149/92
2015/0080567 A1* 3/2015 Salan ..... C06B 25/34 540/475

OTHER PUBLICATIONS

Hongwei Qiu et al., Nanoscale 2CL-20★HMX high explosive cocrystal synthesized by bead milling, CrystEngComm, Apr. 24, 2015, 17, 4080-83, Royal Society of Chemistry.
Onas Bolton et al., High Power Explosive with Good Sensitivity: A 2:1 Cocrystal of CL-20:HMX, Crystal Growth & Design, Aug. 7, 2012, 12, 4311-14, ACS Publications.
Stephen R. Anderson et al., Preparation of an Energetic-Energetic Cocrystal using Resonant Acoustic Mixing, Propellents, Explos. Pyrotech., 2010, 35, 1-5, Wiley.
Victor Stepanov et al., Production and Sensitivity Evaluation of Nanocrystalline RDX-based Explosive Compositions, Propellants Explos. Pyrotech. May 26, 2011, 36, 240-46, Wiley.

* cited by examiner

*Primary Examiner* — James McDonough
(74) *Attorney, Agent, or Firm* — Lisa H. Wang

(57) ABSTRACT

A safe and simple method for synthesizing insensitive nano-size cocrystals of high explosive materials such as HMX and Cl-20 by suspending the explosive materials in a nonsolvent solution and bead milling the solution.

13 Claims, 4 Drawing Sheets

SINGLE-STEP PRODUCTION METHOD FOR NANO-SIZED ENERGETIC COCRYSTALS BY BEAD MILLING AND PRODUCTS THEREOF

RIGHTS OF THE GOVERNMENT

The inventions described herein may be manufactured and used by or for the United States Government for government purposes without payment of any royalties.

FIELD OF INVENTION

The present disclosure generally relates to methods for synthesizing nano-sized cocrystals of explosive materials in a single step bead milling process.

BACKGROUND OF THE INVENTION

The invention described herein relates to a single-step production method for nano-sized cocrystals of explosives, and more specifically, a method capable of converting the desired coformer precursors to cocrystals with a mean crystal size in the nanoscale regime.

A compelling need exists to reduce the sensitivity of energetic materials so that accidental detonations from undesired stimuli such as shock and impact are minimized. This is particularly true for more powerful and generally more sensitive high explosives (HEs). One of the strategies for retaining the performance of these explosives while significantly reducing their sensitivity is to combine the energetic species into cocrystals having physical and chemical properties that are distinguishable from the pure species alone. A cocrystal is generated by combining significant quantities (to exclude cases where one material's presence is essentially a defect in the other material) of two or more coformers through chemical or mechanical means into one crystal structure. The hybrid crystals are unique crystal forms of well-known explosive molecules, possessing novel properties in comparison to the crystalline forms of the individual coformers which constitute them.

One practical application for cocrystals is for use in booster explosives, which must have a sufficient energy output to reliably initiate the newer, relatively insensitive main charge explosive fills, while exhibiting an acceptable level of sensitivity to unintended stimuli. Most existing booster high explosive (HE) formulations have unacceptable levels of sensitivity, thereby increasing the vulnerability of the entire munition to accidental initiation. Cocrystals of these HE formulations having reduced sensitivity while retaining the explosive power of their constituent materials would address these limitations.

Energetic materials such as 2, 4, 6, 8, 10, 12-hexanitro-2, 4, 6, 8, 10, 12-hexaazaisowurtzitane (CL-20) and 1, 3, 5, 7,-tetranitro-1, 3, 5, 7-tetrazocine (HMX) are examples of known high explosives having great explosive performance. CL-20, however, has not been widely used because it is more sensitive, i.e. more readily detonates in comparison to other secondary explosives. HMX is a state of the art explosive having one of the highest detonation velocities in the military. Both explosives are insoluble in water but highly soluble in organic solvents.

Cocrystals of CL-20 and HMX were previously synthesized and reported by Bolton et al., "High Power Explosive with Good Sensitivity: A 2:1 Cocrystal of CL-20:HMX" *Cryst. Growth. Des.,* 2012, 12, 4311-4314 and Anderson et al., "Preparation of an Energetic-Energetic Cocrystal using Resonant Acoustic Mixing" Propellants *Explos. Pyrotech.* 2010, 35, 1-5. Bolton described a solvent based process to create HMX:CL-20 cocrystals, whereby HMX and CL-20 are dissolved in 2-propanol solution and precipitated from the solution. Anderson discussed using solvent drop and resonant acoustic mixing ("RAM"), whereby low frequency, high intensity acoustic energy is applied to the mixing vehicle along with very small amounts of solvent to mechanically mix HMX and CL-20 together until they form a cocrystal.

These solvent based methods, however, often result in impurities or unconverted crystals of the coformer(s) in the final product. Furthermore, these methods of making cocrystals are also relatively difficult to scale.

Nano-sized (less than 1 μm) cocrystals are possibly less sensitive than their counterparts with larger particle size. There have been reports that improved performance characteristics are associated with reducing the size of crystals. For example, the detonation failure diameter, also referred to as the critical diameter, is known to shrink with decreasing crystal size. In addition, HEs with a rounded morphology in plastic bonded explosives were found to produce less sensitive materials. Therefore, a need exists for a safe and simple manufacturing process to synthesize nano-sized cocrystals of energetic materials having improved sensitivity and reactivity.

SUMMARY OF THE INVENTION

The present invention relates to a method of producing nano-sized energetic cocrystals directly from the coformers of the cocrystal. Specifically, the nano-sized energetic cocrystals can be manufactured by bead milling an aqueous suspension of coformers. The suspension typically consists of water as a nonsolvent, the coformers, and optionally, excipients such as a surfactant or mixture of surfactants, an antifoaming agent, binder, or plasticizer. The ratio between the coformers is desirable to be kept at the stoichiometric ratio for the formation of cocrystals. The suspension is loaded into a bead mill and milled for a duration required to completely convert the coformers to the cocrystal (small impurities of the original coformers will, at some level, be impossible to totally eliminate). Once all material has converted to cocrystals, additional milling may be performed to further reduce crystal size.

More specifically, an embodiment of the present invention consists of a process for producing nano-sized cocrystals of high explosive coformers by mixing a suspension comprising explosive coformers in a stoichiometric ratio and a nonsolvent, where the conformers are insoluble in the nonsolvent and dissolving in the suspension at least one excipient. The suspension is subject to bead milling to obtain cocrystals having an average particle size of less than 1 μm, preferably less than 300 nm, and more preferably less than 200 nm.

The single-step production method for nano-sized energetic cocrystals dispersed or suspended in a nonsolvent and bead milling as described in this invention is a novel method of producing energetic cocrystals. In addition, this method integrates the formation of cocrystals and the particle size reduction into one step, producing nano-sized energetic cocrystals. Explosive compositions made using the extremely small energetic cocrystals have the desired characteristics necessary for improved detonation characteristics such as a smaller critical diameter, enabling application of this insensitive material in explosive charges with small dimensions, such as boosters.

The method described in the present invention is suitable for producing a variety of nano-sized energetic cocrystals, including but not limited to known or unknown cocrystals of RDX, HMX, CL-20, diacetone diperoxide. TNT, tribromotrinitrobenzene, TATB, DNAN, NTO, NQ, DNMT, and others.

BRIEF DESCRIPTION OF THE DRAWINGS

Further features and advantages of the present invention may be understood from the drawings.

DETAILED DESCRIPTION

Figure 1:
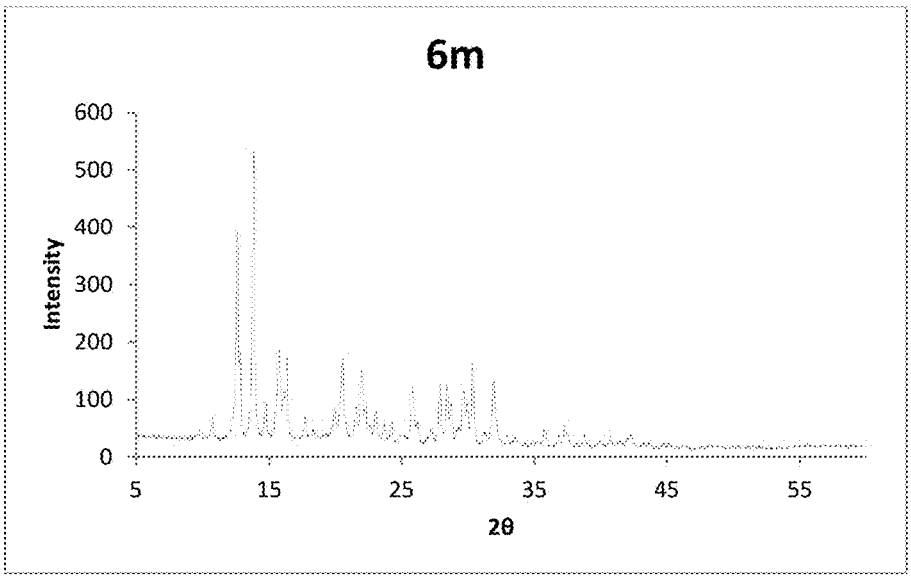
FIG. 1 is an X-Ray diffractogram of HMX and CL-20 after 6 minutes of milling.

The single-step production process for making nano-sized energetic cocrystals as described in the present invention starts with the preparation of a suspension, which consists of the high explosive (HE) coformers of the desired energetic cocrystals with a nonsolvent or mixture of nonsolvents. The suspension mixture may also include excipients that function as a binder, plasticizer, surfactant, and anti-foaming agent. It is contemplated that a single excipient may have multiple functions. Acceptable binders include: polyisobutylene, chlorowax, flourowax, cellulose acetate butyrate, and polyvinyl acetate. Possible surfactants include: polyoxypropylene glycol alkyl ethers, glucoside alkyl ethers, dodecyldimethylamine oxide, docusates and dimethyldioctadecylammonium chloride. Possible antifoaming agents include oils, fatty waxes, ester waxes, alkyl polyacrylates and paraffin waxes. Possible plasticizers include dioctyal adipate, BIS 2.2-Dinitropropyl acetate, BIS 2,2-Dinitropropyl formal, adipates, sebacates, maleates, and trimellitates.

The relative amounts of the various ingredients in the mixture should be chosen to reflect the desired composition of the final product. The coformers should be loaded in the correct stochiometric ratio for forming the specific cocrystal. The loading of the solids, including the coformers, can vary between 0.01-50 wt. % of the suspension. The preferred loading of the solids is about 5% to about 30 wt. %. The selection of the suspension liquid or nonsolvent used in the present invention is flexible, and is based on the solubility of the ingredients to be processed as well as parameters such as viscosity. It is contemplated herein that the coformers should be highly insoluble in the suspension liquid or nonsolvent.

The resultant solution is then placed into a bead mill and milled for the required period of time, which will vary based on the targeted type of cocrystals. The time, speed of milling, and bead size are among factors that will directly affect the conversion from the coformers to the energetic cocrystals and the final particle size, which can be as small as 50 nm.

A number of bead mills are commercially available which allow one to create these types of nano-sized energetic cocrystals. The preferred bead mill is Netzsche Bead Mill (Microseries) with yttria-stabilized zirconia beads. Selection of a proper surfactant can achieve quick formation of cocrystals and the desired reduction of particle size. In some cases, the binder can also act as a suitable surfactant. For laboratory work, the fastest milling speed is desirable because it renders the material quickest, however, for industrial applications energy costs will need to be taken into account. Generally, milling time can control particle size fairly effectively. In some cases, an anti-foaming agent may be required. After milling for a required period of time, nano-sized energetic cocrystals can be obtained by removing them from the suspension using a variety of existing processing techniques including spray drying, freeze drying or filtration.

To aid in the understanding of the subject inventive method, the following examples are provided as illustrative of thereof—however, they are merely examples and should not be construed as limitations on the claims:

Example 1

Nano-sized energetic cocrystals of CL-20/TNT with a molar ratio of 1:1 were prepared by bead milling. The process began by mixing commercially obtained 10.27 g of TNT, 19.73 g of FEM CL-20, 3 g of polyvinyl alcohol (to act as a surfactant/binder), 5 g of isobutanol (to act as antifoaming agent), and 400 g of deionized water. The slurry was milled using a Netzsche Bead Mill (Microseries) with 300 μm size yttria-stabilized zirconia beads. The mill was set to a speed of 6800 rpm and the solution was milled for 60 minutes. The cocrystal structure was confirmed by powder XRD analysis. The crystal size appeared in the nano-scale regime by scanning electron microscopy (SEM).

Example 2

Nano-sized energetic cocrystals of CL-20/HMX with a molar ratio of 2:1 was prepared by bead milling. The process began by mixing 7.5 g of commercially available fluid energy milled (FEM) HMX, 22.2 g of FEM CL-20, 3 g of polyvinyl alcohol (to act as a surfactant/binder), 10 g of isobutanol (to act as antifoaming agent), and 400 g of de-ionized water. Both coformers have a mean particle size of about 1 to 2 μm. The solution was milled using a Netzsche Bead Mill (Microseries) with 300 μm size yttria-stabilized zirconia beads. The mill was set to a speed of 6800 rpm and the solution was milled for 60 minutes.

Figure 2:
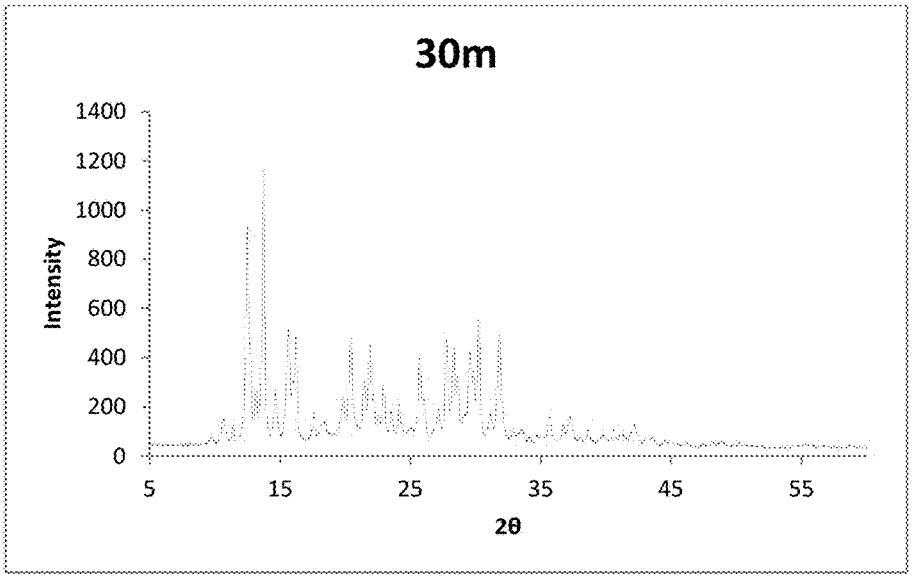
FIG. 2 is an X-Ray diffractogram of HMX and CL-20 after 30 minutes of milling.
Figure 3:
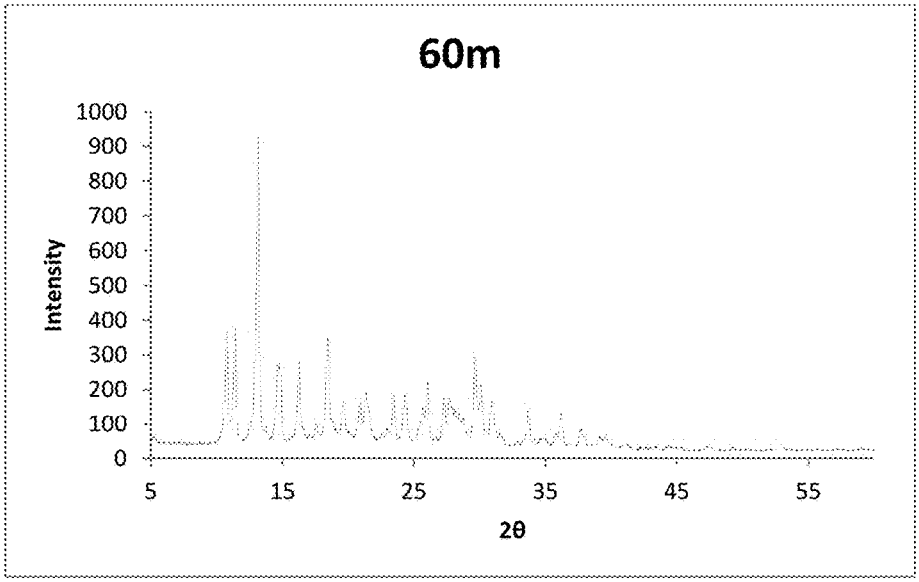
FIG. 3 is an X-Ray diffractogram of HMX and CL-20 after 60 minutes of milling.
Figure 4:
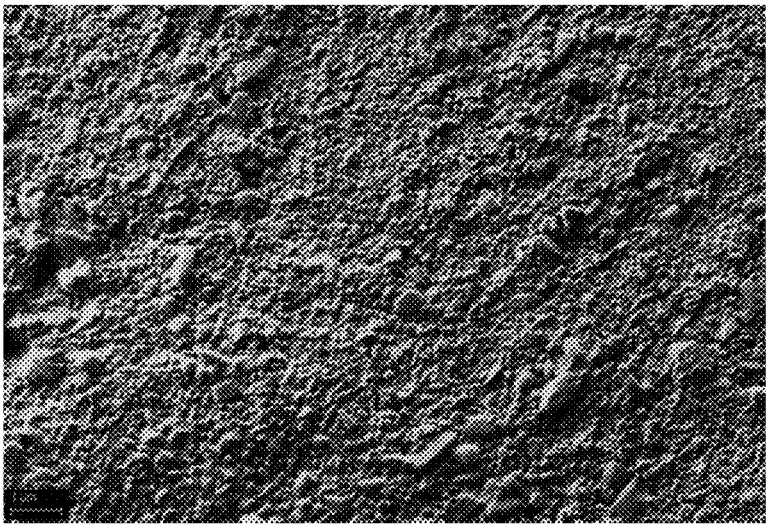
FIG. 4 is a scanning electron micrograph of the cocrystal after 60 minutes of milling.

The formation of cocrystals of CL-20/HMX was confirmed using X-ray diffraction and scanning electron microscopy (SEM) analysis of specimens at various milling times. After 6 minutes of milling, the HMX and CL-20 coformers are in separate crystal phases (FIG. 1). After 30 minutes of milling, the coformers are still in separate crystal phases but are beginning to form cocrystals (FIG. 2). After 60 minutes of milling, the HMX and CL-20 coformers have completely converted to cocrystals (FIG. 3). The size of the energetic cocrystals were observed to be rounded in shape and less than 200 nm using scanning electron microscopy (FIG. 4).

While embodiments have been set forth as illustrated and described above, it is recognized that numerous variations may be made with respect to relative weight percentages of various constituents in the composition. Therefore, while the invention has been disclosed in various forms only, it will be obvious to those skilled in the art that additions, deletions and modifications can be made without departing from the spirit and scope of this invention, and no undue limits should be imposed, except as to those set forth in the following claims.

What is claimed is:

1. A process for producing nano-sized cocrystals of high explosives comprising:

mixing a suspension comprising crystalline high explosive coformers in a stoichiometric ratio and a nonsolvent, wherein said coformers are insoluble in said nonsolvent; dissolving in said suspension at least one excipient; and bead milling said suspension to obtain cocrystals wherein said cocrystals have an average particle size of less than 1 μm and the total weight of the solids in the suspension is between about 0.01% to about 50% by weight.

2. The process of claim 1, wherein the nonsolvent is water.

3. The process of claim 1 wherein the coformers are at least two crystalline high explosives selected from the group comprising RDX, HMX, CL-20, diacetone diperoxide, TNT, tribromotrinitrobenzene, TATB, DNAN, NTO, NQ, DNMT.

4. The process of claim 1, wherein the coformers are CL-20 and HMX.

5. The process of claim 4, wherein the CL-20 and HMX are mixed at a ratio of 2:1 molar ratio.

6. The process of claim 1, wherein the mean particle size of the cocrystals is about 50 nm to about 200 nm.

7. The process of claim 1, wherein the shape of the cocrystals is generally round.

8. The process of claim 1, wherein the total weight of the solids in suspension is about 5% to about 30% by weight.

9. The process of claim 1, wherein the excipient is a surfactant, binder, antifoaming agent, or plasticizer.

10. The process of claim 1, wherein the excipient is an alcohol or a polymer.

11. The process of claim 10, wherein the excipient is polyvinyl alcohol or isobutanol.

12. The process of claim 1, wherein the bead milling is performed for at least 60 minutes.

13. A process for producing nano-sized cocrystal of high explosives comprising:

mixing a suspension comprising;

water,

2:1 molar ratio of Cl-20 to HMX, wherein said HMX and CL-20 is insoluble in the water, polyvinyl alcohol, isobutanol, and;

bead milling said suspension for at least 60 minutes to obtain cocrystals of HMX and CL-20 wherein said cocrystals have an average particle size of about 50 nm to about 300 nm.

* * * * *